US006715313B1

(12) United States Patent
Takafu

(10) Patent No.: US 6,715,313 B1
(45) Date of Patent: Apr. 6, 2004

(54) HEAT PUMP-DRIVEN EXTERNAL COMBUSTION ENGINE

(76) Inventor: Atsusi Takafu, 1-23-3 Hoshigura, Hodgaya-ku, Yokohama, Kangawa (JP)

( * ) Notice: Subject to any disclaimer, the term of this patent is extended or adjusted under 35 U.S.C. 154(b) by 0 days.

(21) Appl. No.: 10/316,033

(22) Filed: Dec. 11, 2002

(51) Int. Cl.[7] ..... F25D 15/00; F01B 29/10

(52) U.S. Cl. ..... 62/331; 60/520; 60/517; 62/238.6

(58) Field of Search ..... 62/238.6, 331; 60/517–526, 670–681

(56) References Cited

U.S. PATENT DOCUMENTS 4,462,212 A * 7/1984 Knoos ..... 60/526

* cited by examiner

*Primary Examiner*—Chen Wen Jiang
(74) *Attorney, Agent, or Firm*—Troxell Law Office PLLC

(57) ABSTRACT

There are many heat sources on the earth, and those heat sources radiate heat continuously. Though some of such heat sources are utilized with heat exchange technologies now, they can't deliver power to us effectively. In addition, though external combustion engines can utilize the heat generated from fuel combustion, they let out much carbon dioxide at the same time.

This invention has solved above problem. In this invention, the driving energy for the external combustion engine (2) comes from the heat ventilation part/absorption part of the heat pump (1); wherein said heat pump (1) is a metal oxide heat pump (11), and said external combustion engine is a Sterling Engine (21) or a thermo-metal engine (22).

6 Claims, 5 Drawing Sheets

HEAT PUMP-DRIVEN EXTERNAL COMBUSTION ENGINE

FIELD OF THE INVENTION

This invention is related to a heat pump-driven external combustion engine, and more particularly to a thermo external combustion engine driven under the heat gathered with a heat pump effectively.

BACKGROUND OF THE INVENTION

The heat source of a legacy thermo external combustion engine comes from the combustion of petroleum, heavy oil, or alcohol, etc. In recent years, however, those combustible materials have been substituted with woods, scraps, or heat transfer media due to emission of carbon dioxide.

However, there are many heat sources on the earth, such as circulating air, sunshine, terrestrial heat, sea water, exhaust heat, etc., and those heat sources radiate heat continuously. Though some of them have been utilized with heat exchange technologies, they can't deliver power to us effectively.

Thermo external combustion engines utilize the heat generated from fuel combustion or accumulated with heat transfer medium as the driving energy for their high temperature sides. According to the Sterling Engine theory, usually it is more effective to elevate the temperature at the high temperature side when one tries to improve the efficiency of the engine through increasing the temperature difference between the high temperature side and the low temperature side. In addition, another problem shall be considered: sole heat transfer medium may not deliver enough energy, but fuel will result in emission of carbon dioxide.

SUMMARY OF THE INVENTION

In consideration of above problems, this invention utilizes a heat pump that transfers the heat energy from an external heat source to its heat ventilation part/absorption part and a thermo external combustion engine that uses the heat energy provided from said heat ventilation part/absorption part of the heat pump; furthermore, the heat pump can be a metal oxide one, and the external combustion engine can be a Sterling Engine.

This invention utilizes a heat pump to gather energy from a natural heat source and then provides the heat energy gathered to the external combustion engine, which utilizes the temperature difference between its high temperature end and low temperature end as the driving force.

In recent years, with the development of technologies, the power generated often exceeds the power consumed in some devices. For example, because that the efficiency of above heat pump is improved up to 4 times, and the efficiency of above external combustion engine is improved up to 35%, the efficiency of dynamic transfer from the external combustion engine to the compressor of the heat pump is increased from 80% to 1.12. Thus the power generated exceeds the power consumed, and the extra power can be transformed into the power consumed to maintain a semi-perpetual motion machine state. In addition, with the reuse of the energy generated from the heat ventilation part/absorption part of the heat pump, the efficiency of the heat pump can be improved up to 4 times or higher. In that way, more extra power can be generated.

DESCRIPTION OF SYMBOLS

1: Heat Pump
1*a:* Heat Ventilation Part
1*b:* Heat Absorption Part
1*c:* Circulation System
1*d:* Compressor
1*f:* Heat Absorption Part to the External Heat Source
1*g:* Compulsory Fan
11: Metal Oxide Heat Pump
11*a,* 11*b:* Sleeve Tube
11*c:* Mated Tube
11*d:* Compressor
11*e,* 11*f:* Heat Ventilation Part to the External Heat Source
11*g,* 11*h:* Heat Absorption Part in the Sleeve Tube
11*i,* 11*j:* Heat Ventilation Part in the Sleeve Tube
11*k,* 11*l:* Heat Ventilation Part
11*m,* 11*n:* Heat Absorption Part
11*o,* 11*p:* Heat Absorption Part to the External Heat Source
11*q,* 11*r:* Circulation Part to the External Heat Source
11*s:* 11*t:* Circulation Pump to the External Heat Source
11*u,* 11*v:* Circulation System at the High Temperature Side
11*w,* 11*x:* Circulation Pump at the High Temperature Side
11*y,* 11*z:* Circulation System at the Low Temperature Side
11*aa,* 11*bb:* Circulation Pump of at Low Temperature Side
2: External Combustion Engine
2*a:* High Temperature Side
2*b:* Low Temperature Side
21: Sterling Engine
21*a:* High Temperature Side
21*b:* Low Temperature Side
21*c,* 21*d:* Cylinder
21*e,* 21*f:* Piston
21*g,* 21*h:* Gas
22: Thermo-Metal Engine
22*a:* Thermo-Metal Plate
22*b:* Movable Plate
3: Revolving Shaft
3*a:* Crank Mechanism

EMBODIMENTS OF THE INVENTION

This invention is related to an external combustion engine 2 driven by a heat pump 1, i.e., the heat from an external heat source is provided to an external combustion engine 2 via a heat pump 1 to drive the external combustion engine 2. The heat pump-driven external combustion engine in claim 1 comprises a heat pump 1 with a heat ventilation part 1*a* and a heat absorption part 1*b* where the heat from an external heat source is transferred and a external combustion engine 2 driven under the heat delivered from the heat ventilation part 1*a* and the heat absorption part 1*b* of the heat pump 1.

The heat pump-driven external combustion engine according to claim 2 develops from the heat pump-driven external combustion engine according to claim 1, with a metal oxide heat pump 11 serving as the heat pump.

The heat pump-driven external combustion engine according to claim 3 develops from the heat pump-driven external combustion engine according to claim 1 or claim 2, with a thermo-metal engine 22 serving as the external combustion engine.

In this invention, the heat from a natural heat source is accumulated in the heat pump 1 to drive the external combustion engine 2 to obtain excellent power efficiency.

Figure 1:
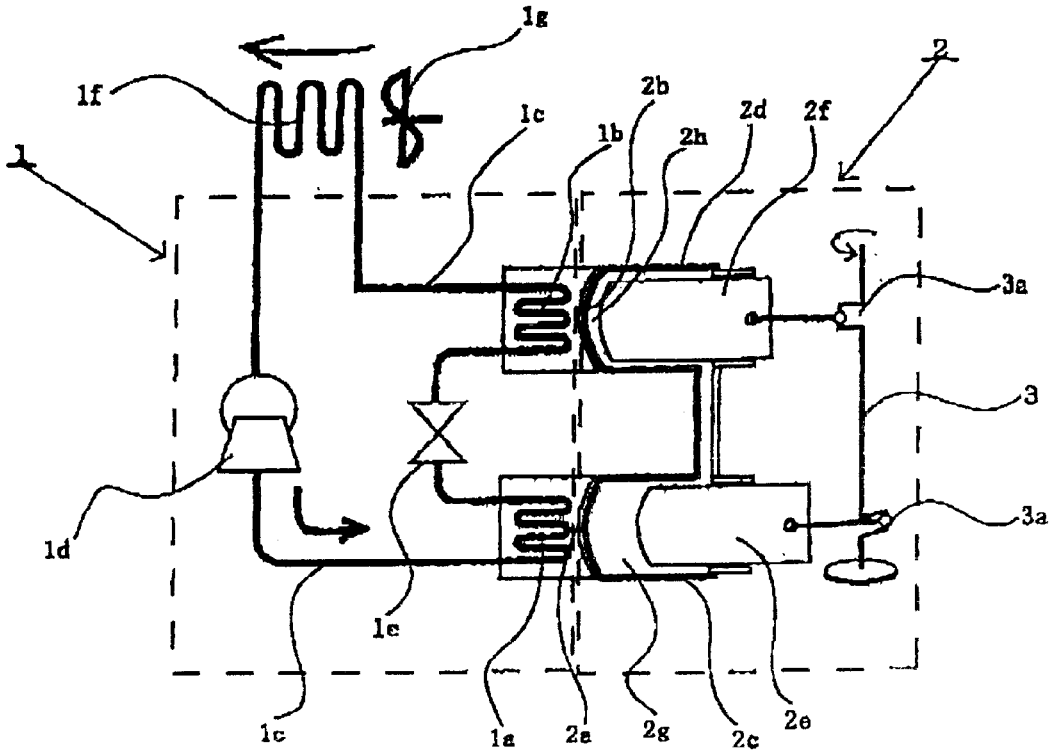
FIG. 1 is a schematic view of an embodiment implemented according to this invention.

As shown in FIG. 1, the heat pump 1 has a circulation system 1*c* comprising a heat transfer medium and a pipeline system; wherein the circulation system 1*c* is equipped with a compressor 1*d* and an expansion valve 1*e*. The circulation system 1*c* has a heat ventilation part 1*a* at one side between the compressor 1*d* and the expansion valve 1*e* and a heat absorption part 1*b* as well as a heat absorption part if to the external heat source at the counterpart side. In order to enhance the heat absorption capability from the external heat source, said heat absorption part 1*f* to the external heat source has a compulsory fan 1*g* nearby.

Under the driving of said compressor 1*d*, the heat absorbed by the heat absorption part 1*f* is carried to the heat ventilation part 1*a* with the heat transfer medium in the circulation system 1*c*, and the heat transfer medium is heated under the pressure generated by the compressor 1*d*. The heat ventilation part 1*a* exchanges heat with the external combustion engine 2 at the high temperature side 2, and then the expansion valve 1*e* is released, resulting in temperature decrease in the heat transfer medium. At the same time, the temperature of the heat absorption part 1*b* also decreases. Then, the heat absorption part 1*b* absorbs heat from the low temperature part 2*b* of the external combustion engine 2. Next, the heat transfer medium in the circulation system 1*c* circulates and absorbs heat from the external heat source via the heat absorption part 1*f*.

Figure 2:
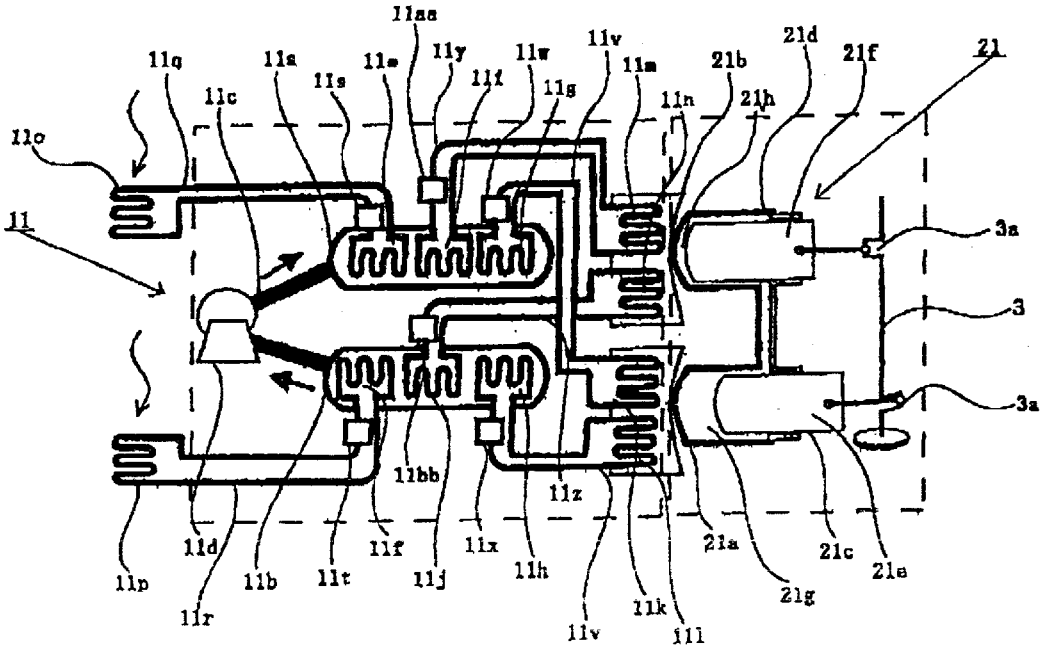
FIG. 2 is a sketch view of another embodiment implemented according to this invention, wherein the heat pump is a metal oxide one.
Figure 3:
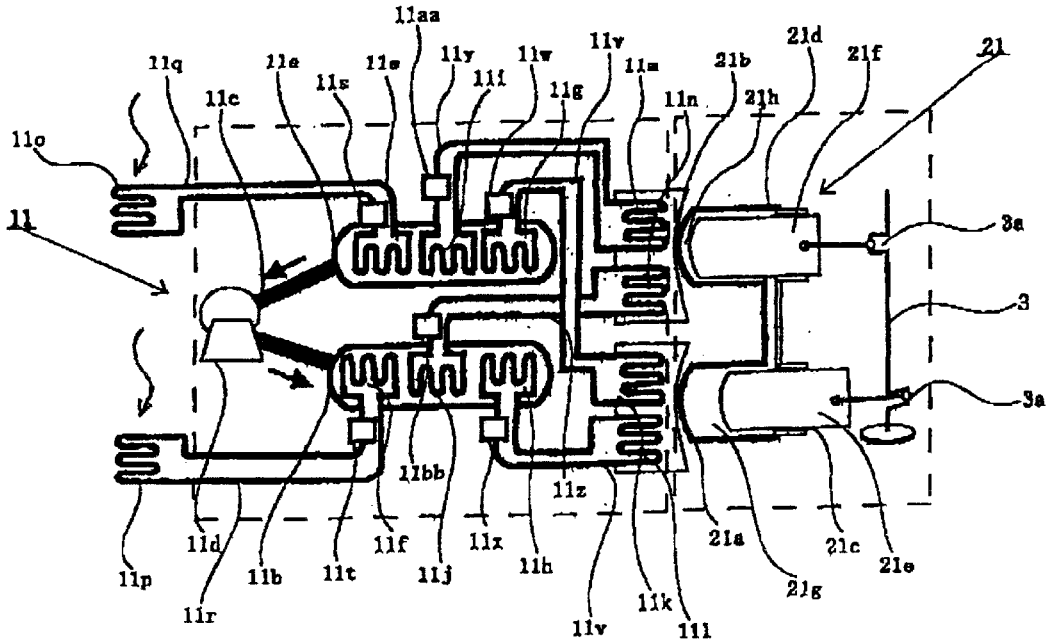
FIG. 3 is a sketch view of the reversed flow of the embodiment in FIG. 2.

The external combustion engine 2 may be a Sterling Engine, Erickson Engine, thermo-metal engine, or extensible metal engine. Hereunder we describe a Sterling Engine 21 case and a thermo-metal engine 22 case:

As shown in FIG. 2 and FIG. 3, a Sterling Engine 21 has a cylinder 21*c*, 21*d* at its high temperature side 21*a* and low temperature side 21*b*, respectively. Said cylinder 21*c*, 21*d* has a piston 21*e*, 21*f* in it, and the piston 21*e*, 21*f* can slide back and forth in the cylinder 21*c*, 21*d*. There is gas 21*g*, 21*h* of a high inflation coefficient enclosed between the cylinder 21*c*, 21*d* and the piston 21*e*, 21*f*. The piston 21*e*, 21*f* is connected to a crank mechanism 3*a*, which in turn is connected to a revolving shaft 3.

The heat ventilation part 1*a* of the heat pump 1 heats the cylinder 21*c* at the high temperature side 21 of the Sterling Engine 21, because that the cylinder 21*c* at the high temperature side 21*a* is close to the heat ventilation part 1*a*, the gas 21*g* in said cylinder 21*c* at the high temperature side 21*a* is heated and inflates to push the piston 21*e* to move outward; the heat absorption part 1*b* of the heat pump 1 cools the cylinder 21*d* at the low temperature side 21*b* of the Sterling Engine 21, because that the cylinder 21*d* at the low temperature side 21*b* is close to the heat absorption part 1*b*, the gas 21*h* in said cylinder 21*d* at the low temperature side 21*b* is cooled and contracts to retract the piston 21*f* to move inward. Under the movement of the pistons 21*e*, 21*f*, the crank mechanism 3*a* connected to the cylinder 21*e*, 21*f* is driven to cycle, and it in turn drives the revolving shaft to revolve.

Figure 4:
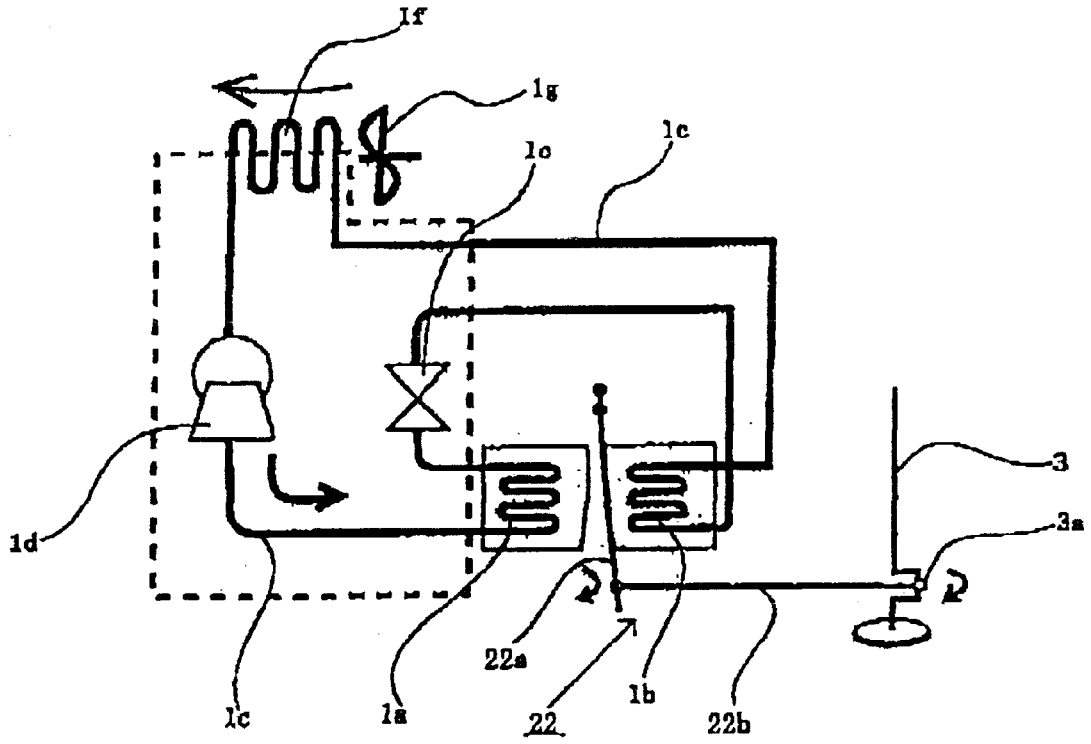
FIG. 4 is a sketch view of another embodiment implemented according to this invention.
Figure 5:
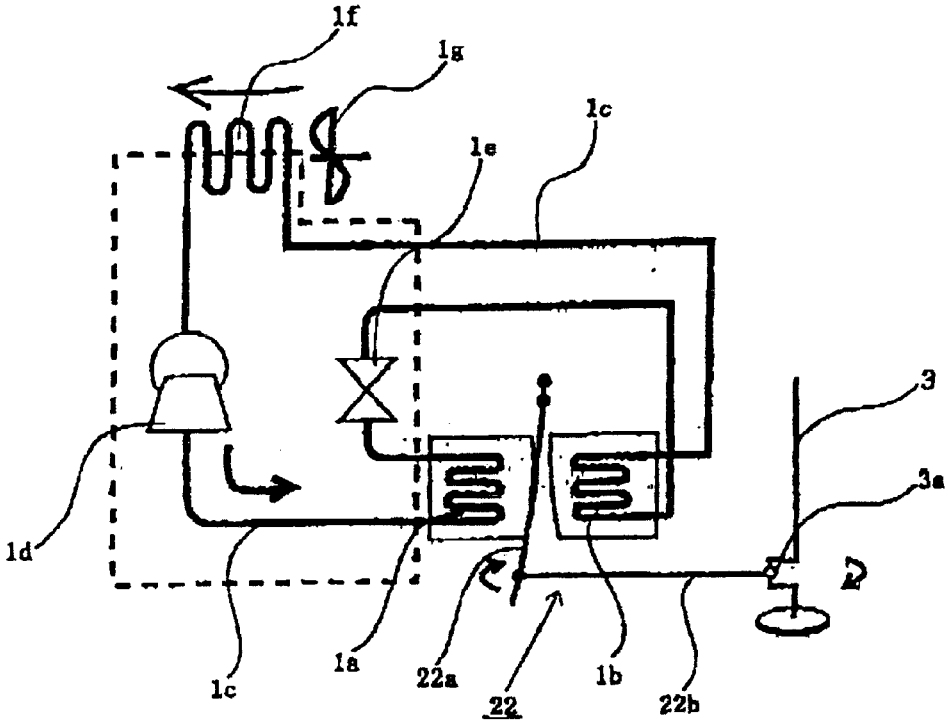
FIG. 5 is a sketch view of another embodiment (in driving state) implement according to this invention.

As shown in FIG. 4 and FIG. 5, a thermo-metal engine comprises two metal plates of different expansion coefficients, which are adhered to each other. The heat ventilation part 1*a* of the heat pump 1 is located at one side of the thermo-metal engine where the expansion coefficient of the metal plate is higher than that of the other metal plate, and the heat absorption part 1*b* of the heat pump 1 is located at the counterpart of the thermo-metal engine. As the temperature on the double-metal plate varies, the double-metal plate 22*a* drives the movable plate 22*b*, which in turn drives the crank mechanism 3*a* and then the revolving shaft 3.

Hereunder we describe the driving state of the heat pump-driven external combustion engine 2 with the embodiment in FIG. 1. First, the high temperature side 2*a* of the external combustion engine 2 is heated to a high temperature with a heater or burner, and the compressor 1*d* is on the circulation system 1*c* (with a pipeline system containing the heat transfer medium) is driven with a battery; As the compressor 1*d* moves, the heat transfer medium in the circulation system 1*c* circulates and carries the heat absorbed at the external heat absorption part 1*f* to the heat ventilation part 1*a*, which exchanges the heat with the high temperature side 2*a* of the external combustion engine 2. That is to say, the high temperature side 2*a* of the external combustion engine 2 is heated to a high temperature, and the gas 2*g* in the cylinder 2*c* inflates and pushes the piston 2*e*, which in turn pushes the crank mechanism 3*a* and then the revolving shaft 3.

Next, the expansion valve 1*e* opens, as the result, the heat transfer medium in the circulation system 1*c* expands and its temperature decreases; the heat absorption part 1*b* of the heat pump 1 exchanges heat with the low temperature side 2*b* of the external combustion engine 2. That is to say, the low temperature side 2*b* of the external combustion engine 2 is cooled to a low temperature, thus the gas 2*h* in the cylinder 2*d* is cooled and contracts to retract the piston 2*f*, which in turn pulls the crank mechanism 3*a* and then the revolving shaft 3.

Above movements of the external combustion engine 2 circle continuously, at the same time, the heat pump 1 gathers heat from the natural heat source, and then transfers the heat energy to the external combustion engine 2 through heat exchange to generate dynamic force.

As shown in FIG. 2 and FIG. 3, the metal oxide heat pump 11 utilizes an oxygen-absorbing element combined with other metal elements, wherein the oxygen-absorbing element will discharge a large quantity of heat when it absorbs oxygen.

Usually, oxygen-absorbing elements include La, Ce, Y, Li, Mg, Ca, Ti, Zr, U, etc. Some steady oxides may be manufactured with about elements. However, some of the oxides will no longer release oxygen when they are formed. With Fe, Ni, Co, Al, Mn, Cu, etc., some of above oxides may be made into alloys that can both absorb and release oxygen easily.

In detail, some alloys absorbs oxygen as the pressure is increased and the temperature (room temperature) is decreased, and they release oxygen as the pressure is decreased and the temperature is increased (>200° C.). In recent years, scientists found that when some elements (e.g., Cr, Ni, Ca, etc.) are added to Ti to form compounds, the compounds will absorb oxygen between 500–1000° C. and discharge a large quantity of energy. Furthermore, for those compounds, the temperature can be increased in 3 stages. Alloys of Ca/Mg absorb oxygen between 300–500° C., while alloys of La/Ni absorb oxygen even at lower temperatures.

Hereunder we introduce metal oxide heat pumps 11. As shown in FIG. 2 and FIG. 3, the sleeve tubes 11*a*, 11*b* are filled with an alloy that can absorb/release oxygen, and they are connected to the mated tube 11*c*, which is in turn connected to a compressor 11*d* that can abstract oxygen from/pump oxygen into the sleeve tubes 11*a*, 11*b*.

Said sleeve tubes 11*a*, 11*b* are mounted together with the external heat ventilation parts 11*e*, 11*f*, the heat ventilation parts 11*k*, 11*l* (connected to the heat absorption parts 11*g*, 11*h* of the sleeve tubes 11*a*, 11*b* near the high temperature side 21 of the Sterling Engine 21 in the heat pump-driven external combustion engine 2, and the heat absorption parts 11*m*, 11*n* connected to the heat ventilation parts 11*i*, 11*j* of the sleeve tubes 11*a*, 11*b*) near the low temperature part 21*b* of the Sterling Engine 21.

The external heat ventilation parts 11*e*, 11*f* comprise the heat absorption parts 11*o*, 11*p* that absorb heat from the external heat source and the circulation systems 11*q*, 11*r* connected to the mated tube filled with the heat transfer medium. Said heat circulation systems 11*q*, 11*r* are equipped with heat circulation pumps 11*s*, 11*t* to facilitate the circulation of the heat transfer medium.

The heat absorption parts 11*g*, 11*h* of the sleeve tubes comprise the heat ventilation parts 11*k*, 11*l* near the high temperature side 21*a* of the Sterling Engine 21 and the high temperature circulation systems 11*u*, 11*v* connected to the mated tube filled with the heat transfer medium. Said high temperature circulation systems 11*u*, 11*v* are equipped with high temperature circulation pumps 11*aa*, 11*bb*.

The metal oxide heat pump 11 is drove by the compressor 11*d* on the mated tube 11*c* between the sleeve tubes 11*a*, 11*b*. The compressor 11*d* compels oxygen from one sleeve tube 11*a* to the other sleeve tube 11*b*. The oxygen is at a high temperature at the sleeve tube 11*b*, while it is cooled at the sleeve tube 11*a*.

Under that state, the sleeve tube 11*a* is connected to the heat ventilation part 11*i* and the heat absorption part 11*m* as well as the circulation system 11*y* at the low temperature side. Under the circulation pump 11*aa* in the low temperature circulation system 11*y*, the heat absorption part 11*m* absorbs heat from the low temperature part 21*b* of the Sterling Engine 21, which is cooled due to loss of heat; at the same time, the high temperature circulation pump 11*w* at the high temperature side 21*a* of the Sterling Engine 21 stops.

On the other hand, the sleeve tube 11*b* is connected with the heat absorption part 11*h* and the heat ventilation part 11*i* as well as the high temperature circulation system 11*v*. Under the driving of the high temperature circulation pump 11*x* at the high temperature circulation system 11*v* of the Sterling Engine 21, the heat ventilation part 11*l* absorbs heat from the sleeve tube 11*b*, thus the high temperature side 21*a* of the Sterling Engine 21 is heated, and the low temperature circulation pump 11*bb* at the low temperature side 21*b* of the Sterling Engine 21 stops.

Then, the compressor 11*d* between the sleeve tubes 11*a*, 11*b* compels oxygen from the sleeve tube 11*b* to the sleeve tube 11*a*; then the sleeve tube 11*b* is at a low temperature, the heat absorption part 11*g* in the sleeve tube 11*a* is connected to the heat ventilation part 11*k* via the high temperature circulation system 11*v* to drive the driving of the high temperature circulation pump 11*w* attached to the high temperature circulation system 11*v*, then the heat ventilation part 11*k* vents heat from the sleeve tube 11*a*; at the same time, the low temperature pump 11*bb* connected to the low temperature part 21*b* *of the Sterling Engine 21 stops.*

On the other hand, the heat ventilation part 11*j* in the sleeve tube 11*b* is connected to the heat absorption side 11*n* via the low temperature circulation system 11*z* to drive the low temperature circulation pump 11*bb* attached to the low temperature circulation system 11*z*, then the heat absorption part 11*n* absorbs heat from the low temperature part 21*b* of the Sterling Engine 21 to cool the low temperature part of the external combustion engine 2; at the same time, the high temperature circulation pump 11*x* connected to the high temperature side 21*a* of the Sterling Engine 21 stops.

This invention utilizes a plurality of heat pumps 1 assembled in parallel to absorb heat from the natural heat source more efficiently. Furthermore, the high temperature side 2*a* and the low temperature side 2*b* of the external combustion engine 2 can be manufactured with dedicated heat pumps 1.

Application Scope of the Invention

The structure describe above need no traditional petrochemical fuel, it extracts energy from natural heat sources (e.g., air circulation, sunshine, earth heat, sea water, and exhaust heat, etc.) instead. With this invention, the power generated may exceed the power consumed, delivering surplus power for any use.

In addition, abundant electricity can be generated at a low price with this invention.

The electricity can be used in household, automobiles, etc.

What is claimed is:

1. A heat pump-driven external combustion engine comprising a heat pump that can transfer heat to its heat ventilation part and heat absorption part and an external combustion engine driven with heat; said external combustion engine utilizes the heat transferred from the heat ventilation part/heat absorption part of the heat pump.

2. The heat pump-driven external combustion engine according to claim 1, wherein said heat pump utilizes a metal oxide alloy that can absorb/release oxygen easily.

3. The heat pump-driven external combustion engine according to claim 2, wherein said external combustion engine is a Sterling Engine.

4. The heat pump-driven external combustion engine according to claim 2, wherein said external combustion engine is a thermo-metal engine.

5. The heat pump-driven external combustion engine according to claim 1, wherein said external combustion engine is a Sterling Engine.

6. The heat pump-driven external combustion engine according to claim 1, wherein said external combustion engine is a thermo-metal engine.

* * * * *